US012225960B2

(12) United States Patent
Coursimault

(10) Patent No.: US 12,225,960 B2
(45) Date of Patent: Feb. 18, 2025

(54) ADJUSTABLE HEADBAND FOR A HELMET AND HELMET PROVIDED WITH ONE SUCH HEADBAND

(71) Applicant: ZEDEL, Crolles (FR)

(72) Inventor: Antoine Coursimault, Grenoble (FR)

(73) Assignee: ZEDEL, Crolles (FR)

( * ) Notice: Subject to any disclaimer, the term of this patent is extended or adjusted under 35 U.S.C. 154(b) by 82 days.

(21) Appl. No.: 17/979,298

(22) Filed: Nov. 2, 2022

(65) Prior Publication Data

US 2023/0132506 A1 May 4, 2023

(30) Foreign Application Priority Data

Nov. 2, 2021 (FR) ..... 2111639

(51) Int. Cl.
*A42B 3/14* (2006.01)
*A42B 3/08* (2006.01)

(52) U.S. Cl.
CPC ..... *A42B 3/145* (2013.01); *A42B 3/085* (2013.01)

(58) Field of Classification Search
CPC ..... A42B 3/145; A42B 3/085
USPC ..... 2/417, 418
See application file for complete search history.

(56) References Cited

U.S. PATENT DOCUMENTS 1,874,872 A * 8/1932 Bowers ..... A61F 9/06 2/8.3
2,419,661 A * 4/1947 Staaf ..... A61F 9/027 2/8.1
2,503,432 A * 4/1950 Bowers ..... A42B 3/145 600/242
2,801,419 A * 8/1957 Tapp ..... A61F 9/06 2/8.1
3,214,768 A * 11/1965 Bohner ..... A61F 9/06 2/10
3,513,333 A * 5/1970 Andersen ..... H03K 3/013 327/227
5,373,588 A 12/1994 Hede et al.
6,226,802 B1 * 5/2001 Sasaki ..... A42B 3/085 2/421
7,114,197 B2 * 10/2006 Garneau ..... A42B 3/085 2/418
7,222,374 B2 * 5/2007 Musal ..... A42B 3/066 24/274 WB (Continued)

FOREIGN PATENT DOCUMENTS

DE 29613682 U1 * 11/1996 ..... A42B 3/14
KR 2001-0096086 A 11/2001

*Primary Examiner* — Grace Huang
(74) *Attorney, Agent, or Firm* — Oliff PLC

(57) ABSTRACT

A headband comprises a strip forming a part of a ring around a user's head. An adjustment device adjusts a circumference of the ring by moving one end of the strip that is fixed to an attachment point movable with respect to the body. A rotary actuator is functionally connected to the adjustment device by means of a transmission so that rotation of the rotary actuator results in movement of the attachment point. The adjustment device comprises a threaded section and a nut. The nut and threaded section form a helical link, wherein rotation of the rotary actuator results in movement of the nut along the threaded section. The nut or threaded section moves along a longitudinal axis of the threaded section and supports the attachment point. A helmet comprises such headband.

8 Claims, 3 Drawing Sheets

(56) References Cited

U.S. PATENT DOCUMENTS

| | | | | |
|---|---|---|---|---|
| 8,037,548 | B2 * | 10/2011 | Alexander | A42B 3/145 2/418 |
| 8,578,521 | B2 | 11/2013 | Rogers et al. | |
| 9,516,911 | B2 * | 12/2016 | Happel | A42B 3/223 |
| 9,706,805 | B2 * | 7/2017 | Pereira | A45F 5/02 |
| 11,576,454 | B1 * | 2/2023 | Wu | A61F 9/06 |
| 2008/0184451 | A1 * | 8/2008 | Lemke | A42B 3/145 2/418 |
| 2011/0191946 | A1 * | 8/2011 | Fang | A42B 3/145 2/418 |
| 2015/0327617 | A1 | 11/2015 | Gaudillere | |
| 2019/0029355 | A1 | 1/2019 | Seo et al. | |
| 2020/0121014 | A1 | 4/2020 | King et al. | |

* cited by examiner

ADJUSTABLE HEADBAND FOR A HELMET AND HELMET PROVIDED WITH ONE SUCH HEADBAND

BACKGROUND OF THE INVENTION

The invention relates to an adjustable headband for a helmet and to a helmet provided with one such headband.

STATE OF THE ART

In a large number of fields and in particular for mountaineering and work at heights, it is common practice to use a helmet. To improve the ergonomics, it is commonplace to use a helmet that is equipped with an adjustable headband. Depending on the configurations, the headband is adjustable as regards its circumference or its shape. The headband comes in the form of a ring the circumference of which can be adjusted to fit the user's head.

The headband has one or two strips and an adjustment device to adjust the overlap length between the strips or the end of the strip. The document EP0558427 describes a helmet provided with a headband in the form of a ring with a system for adjusting the perimeter of the headband that is a rack system fixed on the crown. The rack system enables the perimeter of the headband to be adjusted and also enables the front part and the occipital part of the headband to be moved with respect to the crown. This solution is complicated to implement and is expensive. This embodiment is attractive but imposes an adjustment by means of a plurality of predefined notches. The front portion of the headband and the rear portion of the headband can be adjusted differently.

It is also known to provide an adjustment device by means of a cord fixed to the crown. The cord is associated with a clamp, for example a tanka cord clamp, that will deform the neckband part of the headband to adjust the circumference of the headband. Only the rear part of the headband is adjustable.

The document US 2015/0327617 discloses a protection helmet provided with a neckband that can deform to fit the user's head size.

It is apparent that the prior art configurations are not always very practical to use so that it appears necessary to improve the configuration of the headband.

SUMMARY OF THE INVENTION

One object of the invention consists in remedying these shortcomings, and more particularly in providing a headband that is easier to use than the prior art configurations, and in particular with a better fineness of adjustment.

These shortcomings tend to be overcome by means of a headband for a protection helmet for mountaineering and work at heights comprising:

- a ring designed to pass round a user's head;
- at least a first strip forming at least a part of the ring;
- a first adjustment device configured to adjust a circumference of the ring by moving one end of the first strip, the first adjustment device having a first body designed to be fixed to a crown of the protection helmet;
- at least a first attachment point, the end of the first strip being fixed to the first attachment point, the first attachment point being movable with respect to the first body to define the circumference of the ring;
- a first rotary actuator functionally connected to the first adjustment device by means of a first transmission so that rotation of the first rotary actuator results in movement of the first attachment point with respect to the first body.

The headband is remarkable in that the first adjustment device comprises a main first threaded section with a first thread and a main first nut, the main first nut and the main first threaded section forming a helical link, rotation of the first rotary actuator causing movement of the main first nut along the main first threaded section, at least one of the main first nut and the main first threaded section moving along a longitudinal axis of the main first threaded section and supporting the first attachment point.

According to one feature of the invention, a second strip forms at least a part of the ring. The first adjustment device has a secondary first threaded section with a second thread, a secondary first nut sliding along the secondary first threaded section, one end of the second strip being fixed to an additional first attachment point supported by one of the secondary first nut and the secondary first threaded section.

In preferential manner, the value of the first thread is different from the value of the second thread.

In a particular embodiment, the main first threaded section belongs to a first threaded rod and the secondary first threaded section belongs to a second threaded rod, the first threaded rod and second threaded rod being functionally connected to the first rotary actuator by the first transmission or by the first transmission and a second transmission so that rotation of the first rotary actuator causes rotation of the first threaded rod and of the second threaded rod.

Advantageously, the main first threaded section and the secondary first threaded section belong to a single first threaded rod.

In a particular embodiment, the main first threaded section is separated from the secondary first threaded section by a connecting area, the first transmission applying a force on the connecting area to make the first threaded rod rotate.

Preferentially, the headband comprises a second adjustment device configured to adjust the circumference of the ring, the second adjustment device being provided with a main second threaded section with a first thread and a main second nut, the main second nut and the main second threaded section forming a helical link, at least one of the main second nut and the main second threaded section moving along a longitudinal axis of the main second threaded section and supporting a second attachment point, the second attachment point being mounted movable with respect to the body of the second adjustment device, the second attachment point being fixed to another end of the first strip or to another strip, the second adjustment device being connected to the first rotary actuator or to a second rotary actuator by a second transmission, rotation of the second rotary actuator making the main second nut move along the main first threaded section.

It is a further object of the invention to provide a helmet comprising a headband according to any one of the foregoing configurations and a crown, the headband being fixed to the crown.

Advantageously, the first adjustment device is fixed to a lateral portion of the crown.

DESCRIPTION OF THE DRAWINGS

Other advantages and features will become more clearly apparent from the following description of particular embodiments and implementation modes of the invention given for non-restrictive example purposes only and represented in the accompanying drawings, in which.

DETAILED DESCRIPTION

Figure 1:
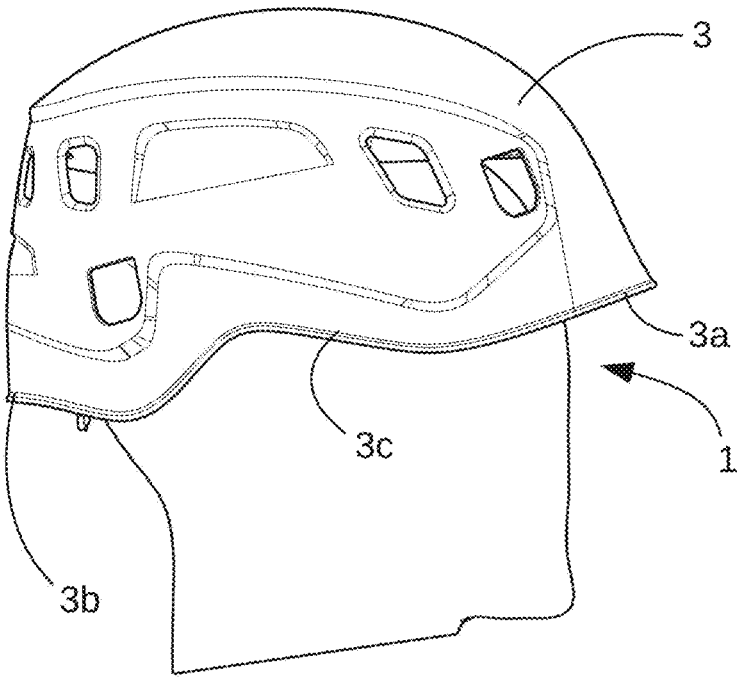
FIG. 1 schematically illustrates a side view of a helmet.
Figure 2:
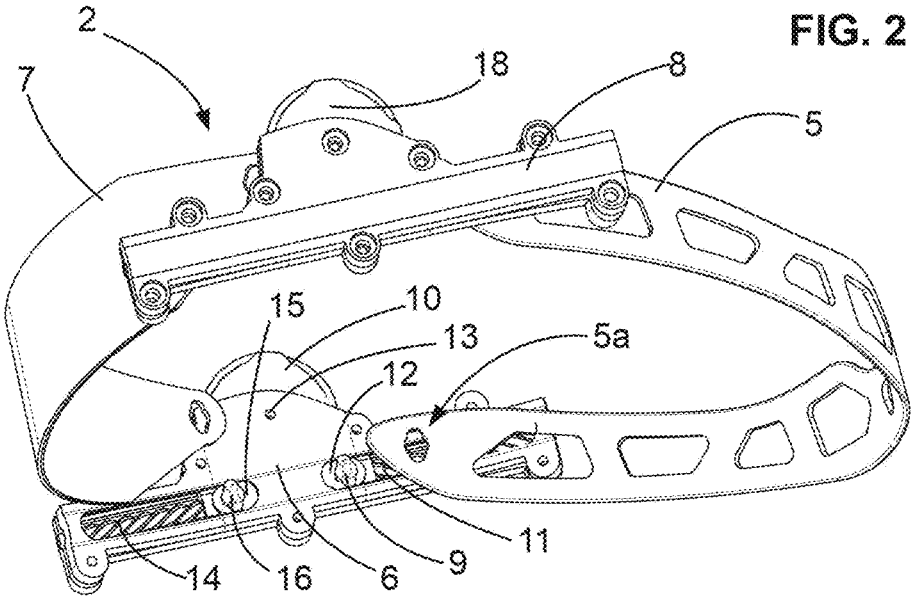
FIG. 2 schematically illustrates a perspective view of a headband according to one embodiment.
Figure 3:
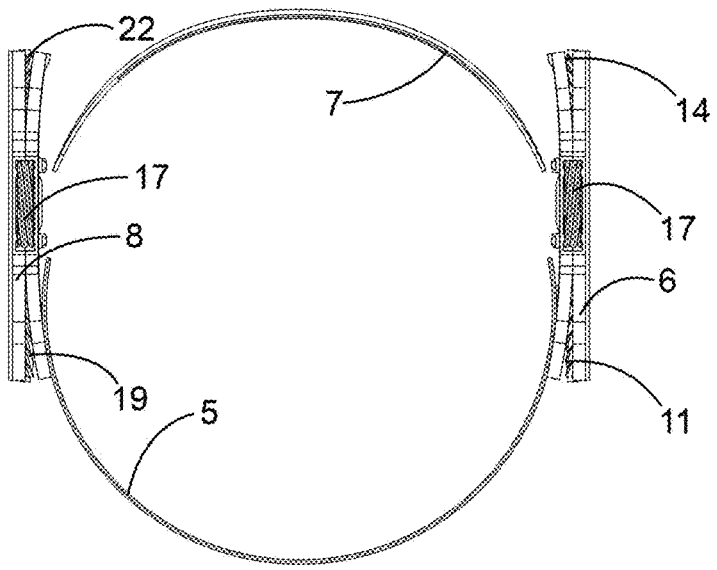
FIG. 3 schematically illustrates a bottom view of the headband illustrated in FIG. 2 without the rotary actuators.
Figure 4:
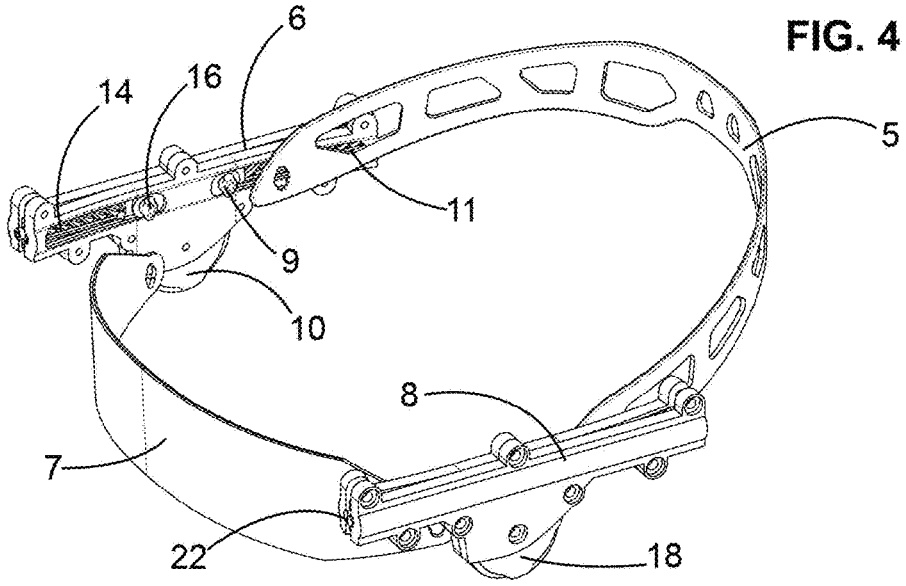
FIG. 4 schematically illustrates a perspective view of the headband illustrated in FIG. 2 with the two strips removed from the adjustment devices.
Figure 5:
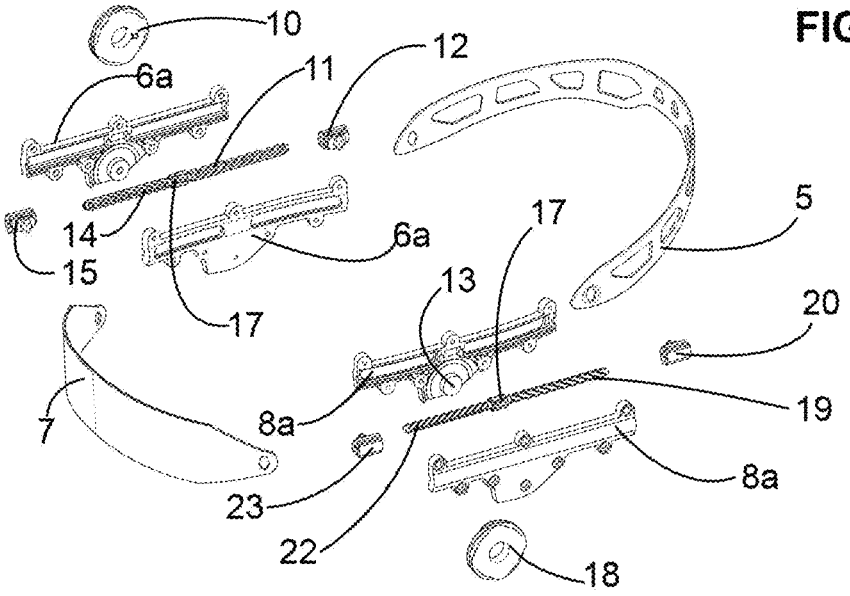
FIG. 5 schematically illustrates an exploded view of a headband represented in FIG. 2.

FIG. 1 represents a protection helmet 1 provided with a headband 2 that is adjustable as regards its circumference. FIGS. 2, 3, 4 and 5 represent a headband 2 having a ring, the circumference of which is adjustable.

The protection helmet 1 comprises a crown 3 made from a material that prevents it from folding onto itself. The crown 3 can be made preferentially from a plastic material, for example from injected polycarbonate or ABS or from polystyrene or from expanded polypropylene, or from any other plastic material, in particular from injected or thermoformed plastic or foam.

The crown 3 comprises a front part 3*a* located at the front, i.e. close to the user's forehead, and an occipital part 3*b* located at the rear. The front part 3*a* is separated from the occipital part 3*b* by two lateral parts 3*c* respectively right and left lateral parts 3*c*. The protection helmet 1 is provided with a headband 2 with a front portion and a rear portion. The rear portion can be a neckband. The headband 2 is fixed to the crown 3 so as to form a ring designed to surround the user's head.

The headband 2 has one or more connectors that are configured to secure the headband 2 to the crown 3. The connection between the headband 2 and the crown 3 can be removable or unremovable. The connectors can define rigid connections or flexible connections between the headband 2 and the crown 3. Securing of the headband 2 with the crown 3 can be performed with rigid connections only, with flexible connections only or with a mixture comprising one or more rigid connections and one or more flexible connections.

The headband 2 has at least a first strip 5 and at least a first adjustment device 6. The first strip 5 forms at least a part of the ring. The first adjustment device 6 is configured to adjust the circumference of the ring. The first strip 5 is designed to come into contact with the head to press on the head and support the crown 3.

In the embodiment illustrated in FIGS. 2 to 6, the headband 2 has a first strip 5 and a second strip 7 and a first adjustment device 6 and a second adjustment device 8. The first adjustment device 6 and the second adjustment device 8 are configured to adjust the circumference of the ring.

Depending on the configurations, the first adjustment device 6 and the second adjustment device 8 can operate independently or not. In one configuration, the first adjustment device 6 and the second adjustment device 8 can act on the front part and the rear part of the ring during adjustment. As an alternative, one of the first adjustment device 6 and the second adjustment device 8 acts on the front part of the ring whereas the other acts on the rear part of the ring. Depending on the configurations, the first adjustment device 6 and the second adjustment device 8 operate simultaneously or they operate independently in time.

In one configuration, a single strip is used and passes round the user's head with the first adjustment device 6. The first adjustment device 6 is fixed to at least one end of the first strip 5. In another configuration, more than one strip is used, such as two strips, as has been illustrated. The first adjustment device 6 moves the first strip 5 and the second strip 7 if applicable to modify the circumference of the ring. It is also possible for the ring to be partially formed by the crown 3. For example, the front part of the ring is formed by the crown 3 and the first strip 5 forms the rear part of the ring. The opposite configuration is possible.

The first adjustment device 6 is configured to adjust the circumference of the ring by moving one end of the first strip 5. The first end of the first strip 5 moves with respect to the crown 3. The first adjustment device 6 has a first body designed to be fixed to the crown 3 of the protection helmet 1. The first body can be removable or unremovable with respect to the crown 3. The first body can be mounted fixedly on the crown 3 or slightly movable with respect to the crown.

The headband 2 has a first attachment point 9 that is mounted movable with respect to the first body. The first attachment point 9 is mounted movable with respect to the crown 3. The end of the first strip 5 is fixed to the first attachment point 9. The end of the first strip 5 can be fitted removable or unremovable with respect to the first attachment point 9. In the illustrated embodiment, the end of the first strip 5 defines a hole, preferably a through hole 5*a*. The first attachment point 9 is formed by a pin that inserts in the hole to secure the first end of the first strip 5 to the first attachment point 9. An opposite configuration with the end of the first strip 5 having a pin and a first attachment point 9 defining a hole is possible. Another system for securing the end of the first strip 5 to the first attachment point 9 is possible.

To modify the circumference of the ring, the headband 2 has a first rotary actuator 10 functionally connected to the first adjustment device 6 by means of a first transmission so that rotation of the first rotary actuator 10 results in movement of the first attachment point 9 with respect to the first body. The first rotary actuator 10 is actuated in rotation, i.e. it rotates around its rotation axis and rotation of the first rotary actuator 10 results in movement of the first attachment point 9 and of the end of the first strip 5 with respect to the first body and with respect to the crown 3 to increase or reduce the circumference of the ring.

In order to provide continuous adjustment of the circumference of the ring thereby more easily matching the precise circumference of the user's head, the first adjustment device 6 comprises a main first threaded section 11 with a first thread and a main first nut 12. The main first nut 12 and the main first threaded section 11 form a helical link. Rotation of the first rotary actuator 10 results in movement of the main first nut 12 along the main first threaded section 11 or vice versa. At least one of the main first nut 12 and the main first threaded section 11 moves along a longitudinal axis of the main first threaded section 11 and supports the first attachment point 9.

In the illustrated configuration, the first attachment point 9 is mounted fixedly on the main first nut 12. Rotation of the first rotary actuator 10 results in rotation of the main first threaded section 11 causing movement of the main first nut 12 with respect to the body along the longitudinal axis of the main first threaded section 11. In the particular embodiment illustrated, the main first threaded section 11 moves only in rotation around a rotation axis that corresponds to the longitudinal axis of the main first threaded section 11. The first strip 5 is fixed to the main first nut 12 and rotation of the first rotary actuator 10 results in translation of the first attachment point 9.

In an alternative embodiment, the first attachment point 9 is mounted on the main first threaded section 11. Rotation of the first rotary actuator 10 causes rotation of the main first nut 12 making the main first threaded section 11 rotate. The first strip 5 is fixed to the main first threaded section 11. Rotation of first actuator 10 results in rotation of the main first nut 12 and translation of first threaded section 11. The main first threaded section 11 moves with respect to the crown 3 in the form of a translation along the longitudinal axis of the main first threaded section 11.

Other more or less complex configurations with a more or less large bulk are possible using at least the main first threaded section 11 and the main first nut 12 to move the first attachment point 9 when the first rotary actuator 10 rotates.

In the illustrated embodiment, the first rotary actuator 10 is mounted around a rotation shaft 13 that is fixed to the first body of the first adjustment device 6. In an alternative embodiment, the first rotary actuator 10 is located at a distance from the first body. The first rotary actuator 10 is functionally connected to the helical link by means of the first transmission that comprises a flexible transmission shaft. The first transmission can also be a cable or any other means for transferring the rotation torque applied on the first rotary actuator 10 into a force or a torque on the first adjustment device 6.

It is particularly advantageous to use a helical link between the main first nut 12 and the main first threaded section 11 in order to adjust the circumference of the ring. This mechanical connection enables a precise and continuous adjustment of the circumference of the ring. The helical link enables the main first nut 12 to be moved with respect to the main first threaded section 11 and the position of the main first nut 12 with respect to the main first threaded section 11 to be preserved when a force is applied on the main first nut 12 or on the main first threaded section 11. The first rotary actuator 10 enables the circumference of the ring to be adjusted but the forces applied on the strip of the headband have little or no effect on movement of the main first nut 12 with respect to first threaded section 11. An identical operating mode is obtained in an adjustable spanner that also uses a helical link.

In an advantageous embodiment illustrated in FIGS. 2 to 5, the headband 2 has a second strip 7 that forms at least a part of the ring. The first adjustment device 6 has a secondary first threaded section 14 with a second thread. A secondary first nut 15 slides along the secondary first threaded section 14. One end of the second strip 7 is fixed to an additional first attachment point 16 that is supported by one of the secondary first nut 15 and the secondary first threaded section 14. The first adjustment device 6 has two threaded sections, the main first threaded section 11 and the secondary first threaded section 14 with two nuts 12 and 15 that are arranged to define two helical links. The two helical links are connected to two different points of the ring. In preferred manner, the two helical links enable the circumference of the ring to be modified in its front part and in its rear part to keep helmet 1 centered with respect to the median front plane of the user.

It is particularly advantageous to provide for the first rotary actuator 10 to be functionally connected to the main first helical link and to the secondary first helical link. The main first helical link is formed by the main first threaded section 11 and the main first nut 12. The secondary first helical link is formed by the secondary first threaded section 14 and the secondary first nut 15.

In a particular configuration, the main first helical link and the secondary first helical link are mechanically connected by an additional transmission enabling the first helical links to be actuated simultaneously. In this way, rotation of the first rotary actuator 10 simultaneously actuates the main first helical link and the secondary first helical link. In preferential manner, for a predefined rotation of the first rotary actuator 10, the main first helical link generates a first value of movement of the main first attachment point 9 that is different from the value of movement of the secondary first attachment point 16.

This difference in the length of movement can be obtained by a difference in the speed of rotation of the first helical link with respect to the speed of rotation of the second helical link. In the embodiment illustrated in FIG. 6, the additional transmission can be formed by a gear mechanism, at least a belt or any other equivalent device that introduces this difference in the speeds of rotation. As an alternative or as a complement, the main first threaded section 11 has a first thread different from the second thread of the secondary first threaded section 14.

In another configuration, the main first threaded section 11 and the secondary first threaded section 14 are both connected independently to the first rotary actuator 10.

The use of two movable attachment points, i.e the main first attachment point 9 and the secondary first attachment point 16 that are connected to two strips or to two ends of the single strip enables centering of the crown with respect to the median front plane for different circumferences of the ring to be better controlled.

It is preferable to have a ratio between the first thread and the second thread that keeps the median front plane of the head coinciding with the median front plane of the helmet. It is advantageous to have a first thread that is larger than the second thread so that rotation of the first rotary actuator through one turn presents a greater effect on the front portion of the ring than on the rear portion of the ring.

Provision of a first adjustment device 6 provided with a main first threaded section 11 and a secondary first threaded section 14 can be achieved in different forms.

In a particular embodiment, the main first threaded section 11 belongs to a first threaded rod and the secondary first threaded section 14 belongs to a second threaded rod. In the illustrated configuration, the first threaded rod and second threaded rod are functionally connected to the first rotary actuator 10 so that rotation of the first rotary actuator 10 simultaneously results in rotation of the first threaded rod and of the second threaded rod. The first threaded rod and second threaded rod can be functionally connected to the first rotary actuator 10 by the first transmission or by the first transmission and a second transmission so that rotation of the first rotary actuator 10 results in rotation of the first threaded rod and of the second threaded rod.

Figure 6:
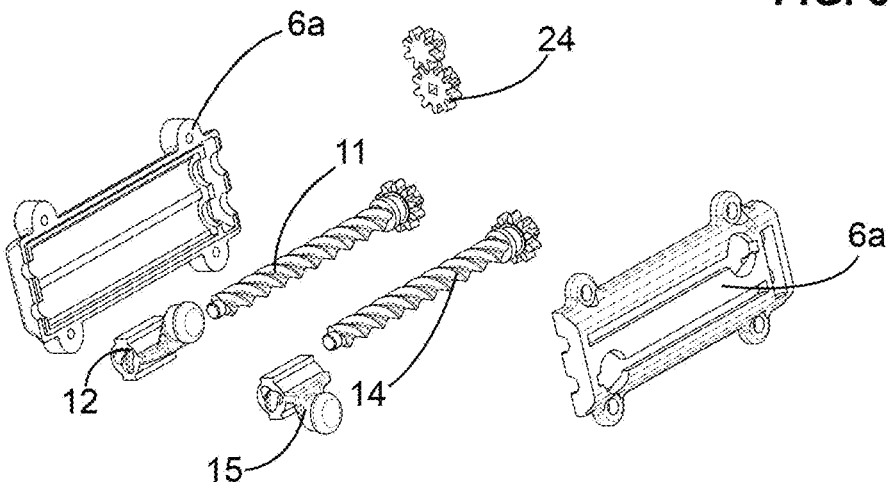
FIG. 6 schematically illustrates an exploded view of another embodiment of an adjustment device of a headband.

As illustrated in FIG. 6, the first threaded rod can be connected to the second threaded rod by one or more gears enabling the speed of rotation between the first threaded rod and the second threaded rod to be differentiated for a given speed of rotation of the first rotary actuator. The gear or gears can be replaced by a belt or by any other equivalent transmission system. As an alternative or in combination, the first rotary actuator 10 is connected to the first threaded rod by a first transmission and the first rotary actuator 10 is connected to the second threaded rod by a second transmission. The first transmission can be different from the second transmission to modify the speed of rotation of the first threaded rod with respect to the second threaded rod for a given speed of rotation of the first rotary actuator 10.

In another embodiment, the main first threaded section 11 and the secondary first threaded section 14 belong to a single first threaded rod.

In one embodiment, the main first threaded section 11 is separated from the secondary first threaded section 14 by a connecting area 17. The first transmission applies a force on the connecting area 17 to make the main first threaded section 11 and the secondary first threaded section 14 rotate. In an advantageous configuration illustrated in FIG. 5, the first transmission has a gear engaging with the first threaded rod.

When the first rotary actuator 10 is securedly fixed to the first body of the first adjustment device 6, it is advantageous for the first rotary actuator 10 to be in the form of a toothed wheel with grooves running over the periphery of the wheel. The grooves engage on other grooves formed on the periphery of the first threaded rod. Rotation of the first rotary actuator 10 results in rotation of the first threaded rod. The grooves formed on the periphery of the first threaded rod form the connecting area 17.

In more general manner, the first rotary actuator 10 is preferentially connected to the first threaded rod on a connecting area 17 located between the main first threaded section 11 and the secondary first threaded section 14. This configuration makes it easier to obtain a connecting area 17 that is substantially fixed with respect to the crown 3, i.e. it does not move in translation along the longitudinal axis of the threaded rod.

To make adjustment of the circumference of the ring easier to perform, it is advantageous to use a first adjustment device 6 and a second adjustment device 8. The use of two adjustment devices enables the amplitude of adjustment of the circumference of the ring to be increased, preferably to be doubled.

Preferentially, a second adjustment device 8 is used that is identical or substantially identical to the first adjustment device 6. The second adjustment device can present one of the multiple configurations defined in the foregoing. The configuration of the second adjustment device 8 is independent from that of the first adjustment device 6.

In the illustrated embodiment, a second rotary actuator 18 is used that is connected to the second adjustment device 8 by means of a second transmission.

The second adjustment device 8 is configured to adjust the circumference of the ring. The second adjustment device 8 is provided with a main second threaded section 19 with a first thread and a main second nut 20. The main second nut 20 and the main second threaded section 19 form a helical link. At least one of the main second nut 20 and the main second threaded section 19 moves along a longitudinal axis of the main second threaded section 19 and supports a main second attachment point. The main second attachment point is mounted movable with respect to the second body of the second adjustment device 8. The main second attachment point is fixed to another end of the first strip 5 or to another strip 7. The second adjustment device 8 is connected to a second rotary actuator 18 by a second transmission. Rotation of the first rotary actuator 10 or the second rotary actuator 18 results in movement of the main second nut 20 along the main second threaded section 19.

It is advantageous for the second adjustment device 8 to have a secondary second threaded section 22 that cooperates with secondary second nut 23 to form a secondary second helical link. The functioning of the helical link is identical to that described in the foregoing for the first adjustment device 6.

The second adjustment device 8 can have a single threaded rod or two threaded rods. The first strip 5 is fixed to the main attachment points and the second strip 7 is fixed to the secondary attachment points. In the illustrated embodiment, the secondary attachment points are formed by the two nuts, i.e. the main second nut 20 and the secondary second nut 23.

It is advantageous to install the first adjustment device 6 and the second adjustment device 8 as a right adjustment device and a left adjustment device. The use of the first adjustment device 6 and the second adjustment device 8 enables the extent of modification of the circumference to be increased and/or the bulk of each adjustment device to be reduced. It is then easier to integrate the adjustment device within the volume delineated by the crown 3. It is easier to install the adjustment device in the thickness of a foam that is arranged between the crown 3 and the user's head.

In preferential manner, the first value of the first thread of first adjustment means 6 is identical to the first value of the first thread of second adjustment means 8. The same is preferentially the case for the values of the second threads.

In the second adjustment device, the main second threaded section 19 is separated from secondary second threaded section 22 of the second threaded rod by a connecting area 17 that is functionally connected with the second transmission in order to be actuated by the second rotary actuator 18.

In the illustrated embodiments, the first rotary actuator 10 is mounted rotating around a rotation axis that is perpendicular or substantially perpendicular to the wall of the crown 3 close to its attachment point. This configuration enables the first rotary actuator 10 to be more easily integrated in the inner volume of the helmet delineated by the crown 3. This configuration enables the perimeter of the headband to be adjusted more easily when the helmet is worn without having to change the configuration of the crown 3.

In another embodiment, the first rotary actuator 10 is mounted rotating around a rotation axis that is parallel or substantially parallel to the wall of the crown 3 close to its attachment point. It is advantageous to form an aperture in the crown 3 to have access to the first rotary actuator 10 and rotate the latter.

In the illustrated embodiments, each of the first adjustment device 6 and the second adjustment device 8 is fixed directly to the crown 3 and each of the first adjustment device 6 and the second adjustment device 8 defines a rotation axis 13 that is arranged in fixed manner for rotation of the first rotary actuator 10 and the second rotary actuator 18.

In a particular embodiment, the first rotary actuator 10 is connected to the first adjustment device 6 by a first transmission and is connected to the second adjustment device 8 by a second transmission. The first transmission and second transmission transmit the rotation torque of the first rotary actuator 10 to the first adjustment device 6 and to the second adjustment device 8.

In a particular embodiment, the first rotary actuator 10 is mounted on the rear portion of the crown 3 and is connected to the first adjustment device 6 and to the second adjustment device 8 fitted on the right and left sides of the crown 3 by a first transmission and a second transmission. In an alternative embodiment, the first rotary actuator 10 is mounted on another portion of the crown 3.

In the illustrated embodiments, the first body of the first adjustment device 6 and the second body of the second adjustment device 8 are formed by two shells 6*a* or 8*a* that enclose the threaded rod or rods.

In a preferential manner, two threaded rods that are mechanically connected to one another by two toothed wheels so that the two threaded rods rotate simultaneously. The embodiment of FIG. 6 also illustrates actuation of the two threaded rods by a gear system 24.

In a preferential manner, the headband 2 is provided with a neckband, i.e. a rear portion of the ring that is fitted movable in rotation with respect to the front portion of the ring. It is advantageous for the rotation shafts of the neckband to be formed by the attachment points so as to have movable rotation shafts moved by the first rotary actuator 10.

In the illustrated embodiments, each adjustment device has a body that is fitted securedly on the crown 3 by means of a connector defining a rigid connection.

The invention claimed is:

1. A helmet comprising:

a crown;

a headband configured to extend around a user's head, the headband comprising:

a first strip and a second strip, the first strip being distinct from the second strip;

a first adjustment device having a first body attached to a first part of the crown, and a first attachment point and an additional first attachment point that are each mounted movably with respect to the first body; and a second adjustment device having a second body attached to a second part of the crown, and a second attachment point and an additional second attachment point that are each mounted movably with respect to the second body, wherein:

the first attachment point is fixed to a first end of the first strip and the additional first attachment point is fixed to a first end of the second strip;

the second attachment point is fixed to a second end of the first strip and the additional second attachment point is fixed to a second end of the second strip;

the first adjustment device moves the first attachment point and the additional first attachment point with respect to the first body to adjust a circumference of the headband;

the second adjustment device moves the second attachment point and the additional second attachment point with respect to the second body to adjust the circumference of the headband;

the first adjustment device comprises a main first threaded section with a first thread and a main first nut, the main first nut and the main first threaded section forming a helical link, one of the main first threaded section and the main first nut supporting the first attachment point;

the first adjustment device comprises a secondary first threaded section with a second thread and a secondary first nut, the secondary first threaded section and the secondary first nut forming a helical link, one of the secondary first threaded section and the secondary first nut supporting the additional first attachment point; and the second adjustment device comprises a main second threaded section with a third thread and a main second nut, the main second nut and the main second threaded section forming a helical link, one of the third thread and the main second nut supporting the second attachment point.

2. The helmet according to claim 1, wherein:

the first part of the crown is a first lateral part of the crown, and the second part of the crown is a second lateral part of the crown, the first strip forming a frontal strip and the second strip forming a rear strip.

3. The helmet according to claim 2, wherein:

the main first threaded section and secondary first threaded section belong to a single first threaded rod, and for a predefined rotation of the single first threaded rod, the main first threaded section defines a first length of movement of the first nut and the secondary first threaded section defines a second length of movement of the secondary first nut, the first length of movement being different from the second length of movement.

4. The helmet according to claim 2, wherein the main first threaded section belongs to a first threaded rod and the secondary first threaded section belongs to a second threaded rod, the first threaded rod and the second threaded rod being functionally connected to a first rotary actuator so that rotation of the first rotary actuator results in rotation of the first threaded rod and of the second threaded rod.

5. The helmet according to claim 2, wherein the first adjustment device and the second adjustment device work independently.

6. The helmet according to claim 5, wherein the main first threaded section is separated from the secondary first threaded section by a connecting area.

7. The helmet according to claim 1, wherein:

the main first threaded section and secondary first threaded section are connected by one or more gears to enable different speeds of rotation between the main first threaded section and secondary first threaded section, and for a predefined rotation of the single first threaded rod, the main first threaded section defines a first length of movement of the first nut and the secondary first threaded section defines a second length of movement of the secondary first nut, the first length of movement being different from the second length of movement.

8. A helmet comprising:

a crown;

a headband configured to extend around a user's head, the headband comprising:

a first strip and a second strip, the first strip being distinct from the second strip;

a first adjustment device having a first body attached to a first lateral part of the crown, and a first attachment point and an additional first attachment point that are each mounted movably with respect to the first body; and a second adjustment device having a second body attached to a second lateral part of the crown, and a second attachment point and an additional second attachment point that are each mounted movably with respect to the second body, wherein:

the first attachment point is fixed to a first end of the first strip and the additional first attachment point is fixed to a first end of the second strip;

the second attachment point is fixed to a second end of the first strip and the additional second attachment point is fixed to a second end of the second strip;

the first adjustment device moves the first attachment point and the additional first attachment point with respect to the first body to adjust a circumference of the headband;

the second adjustment device moves the second attachment point and the additional second attachment point with respect to the second body to adjust the circumference of the headband;

the first adjustment device comprises a main first threaded section with a first thread and a main first nut, the main first nut and the main first threaded section forming a helical link, one of the main first threaded section and the main first nut supporting the first attachment point;

the first adjustment device comprises a secondary first threaded section with a second thread and a secondary first nut, the secondary first threaded section and the secondary first nut forming a helical link, one of the secondary first threaded section and the secondary first nut supporting the additional first attachment point; and the second adjustment device comprises a main second threaded section with a third thread and a main second nut, the main second nut and the main second threaded section forming a helical link, one of the third thread and the main second nut supporting the second attachment point.

* * * * *